US008746528B2

(12) United States Patent
Koike et al.

(10) Patent No.: US 8,746,528 B2
(45) Date of Patent: Jun. 10, 2014

(54) COMBUSTION TYPE DRIVING TOOLS

(75) Inventors: Yoichiro Koike, Anjo (JP); Jiro Oda, Anjo (JP); Hidekazu Suda, Anjo (JP)

(73) Assignee: Makita Corporation, Anjo-shi (JP)

( * ) Notice: Subject to any disclaimer, the term of this patent is extended or adjusted under 35 U.S.C. 154(b) by 219 days.

(21) Appl. No.: 12/669,816

(22) PCT Filed: Jul. 23, 2008

(86) PCT No.: PCT/JP2008/063159

§ 371 (c)(1),
(2), (4) Date: Feb. 4, 2010

(87) PCT Pub. No.: WO2009/014132

PCT Pub. Date: Jan. 29, 2009

(65) Prior Publication Data

US 2010/0176176 A1 Jul. 15, 2010

(30) Foreign Application Priority Data

Jul. 26, 2007 (JP) ..... 2007-194568

(51) Int. Cl.
*B25C 1/04* (2006.01)

(52) U.S. Cl.
USPC ..... 227/9; 227/10; 123/46 SC

(58) Field of Classification Search
USPC ..... 227/9, 10, 11, 2; 123/46 SC, 46 H, 46 R
See application file for complete search history.

(56) References Cited

U.S. PATENT DOCUMENTS

| | | | | |
|---|---|---|---|---|
| 2,793,305 | A * | 5/1957 | Gerentes | 310/50 |
| 5,197,646 | A * | 3/1993 | Nikolich | 227/8 |
| 5,401,928 | A * | 3/1995 | Kelley | 200/510 |
| 6,520,397 | B1 | 2/2003 | Moeller | |
| 6,803,683 | B2 * | 10/2004 | Bone et al. | 310/50 |
| 6,951,194 | B2 * | 10/2005 | Nishikawa et al. | 123/46 R |
| 7,063,052 | B2 * | 6/2006 | Nishikawa et al. | 123/46 SC |
| 2003/0127488 | A1 * | 7/2003 | Wagdy | 227/9 |
| 2003/0146259 | A1 | 8/2003 | Shkolnikov et al. | |
| 2005/0229598 | A1 | 10/2005 | Akiba et al. | |
| 2006/0185630 | A1 | 8/2006 | Fujisawa et al. | |
| 2006/0186166 | A1 | 8/2006 | Akiba | |
| 2007/0101954 | A1 | 5/2007 | Zahner et al. | |

FOREIGN PATENT DOCUMENTS

| | | | |
|---|---|---|---|
| CN | 85 1 00409 | A | 7/1986 |
| CN | 1222432 | A | 7/1999 |
| CN | 2333583 | Y | 8/1999 |
| CN | 2526963 | Y | 12/2002 |
| EP | 1 398 118 | A1 | 3/2004 |
| EP | 1 588 804 | A2 | 10/2005 |
| JP | A-2003-260674 | | 9/2003 |

(Continued)

OTHER PUBLICATIONS

Chinese Office Action issued in Chinese Application No. 200880100357.X dated Apr. 8 2011 (with translation).

International Search Report for International Application No. PCT/JP2008/063159, issued Aug. 26, 2008.

(Continued)

*Primary Examiner* — Thanh Truong

*Assistant Examiner* — Nathaniel Chukwurah

(74) *Attorney, Agent, or Firm* — Oliff PLC

(57) ABSTRACT

A fan switch and an ignition switch are arranged such that the moving directions of operating buttons thereof cross the moving directions of a contact lever and the moving direction of a switch lever, respectively.

8 Claims, 5 Drawing Sheets

(56) References Cited

FOREIGN PATENT DOCUMENTS

| | | |
|---|---|---|
| JP | A-2004-351569 | 12/2004 |
| JP | A-2005-329533 | 12/2005 |
| JP | A-2006-224271 | 8/2006 |
| JP | A-2006-255880 | 9/2006 |
| JP | A-2007-125692 | 5/2007 |

OTHER PUBLICATIONS

Apr. 12, 2012 Office Action issued in Chinese Patent Application No. 200880100357.X with English-language translation.
Aug. 3, 2012 Office Action issued in Chinese Patent Application No. 200880100357.X (with translation).
Feb. 18, 2013 Search Report issued in European Patent Application No. 08778324.7.

* cited by examiner

COMBUSTION TYPE DRIVING TOOLS

TECHNICAL FIELD

This invention relates to combustion type driving tools operated through combustion of a combustible gas.

BACKGROUND ART

This type of driving tool is constituted such that an upper chamber of a piston equipped with a driver for striking driven members, such as nails, is configured as a combustion chamber, and a combustible gas and air are supplied into this combustion chamber to be agitated through rotation of a fan and ignited by an ignition plug, thereby causing combustion (explosion), so that the resultant combustion pressure impulsively downwardly moves the piston to thereby obtain a striking force; the combustible gas is supplied from a cassette type gas cylinder, and the supply of power to the ignition plug is effected by a battery pack, thereby achieving an improvement in terms of transportability and ease of handling.

Conventionally, as a technique related to this kind of combustion type driving tool, the one as disclosed, for example, in JP 2006-255880 is publicly known. This patent document discloses a technique in which a microswitch for controlling the supply of the combustible gas into the combustion chamber and the activation of the agitating fan, or a microswitch for controlling the ignition of the ignition plug in the combustion chamber, is assembled in a state that it is surrounded by a rubber switch protector, whereby the microswitch is protected from the impact at the time of driving or the like.

SUMMARY OF THE INVENTION

However, the above-mentioned switch protection structure still needs a further improvement in order to more reliably avoid damage thereof. That is, while in the above-mentioned switch protection structures, switch main bodies are protected from damage by being covered with the protectors, the impact applied to operating buttons that are usually provided to such microswitches and, eventually, the impact applied to switch contacts, is not taken into consideration, so that protection from the impact has to be provided also in this respect.

Therefore, there is a need in the art for mitigating potential impact that may be applied to microswitches of a combustion type driving tool.

In one aspect of the present invention, an electric motor for rotating a fan for effecting agitation in a combustion chamber is started through an ON operation of a fan switch, and an ignition plug for igniting a combustible gas supplied to the combustion chamber is operated through an ON operation of an ignition switch, and operating buttons of both switches are turned on through movement of members moving in directions crossing the moving directions of the operating buttons. Thus, not all the impact applied to the members through a driving motion or the like is applied to the operating buttons of both switches in the moving directions thereof, so that it is possible to mitigate the impact directly applied to the operating buttons, thereby preventing damage of both switches and enhancing the durability thereof.

As the members moving in the directions crossing the moving directions of operating buttons of both switches, it is possible to use, for example, a contact lever moving relative to the tool main body portion, and a switch lever to be pulled by the user.

Further, the members move in directions crossing the moving directions of the operating buttons to turn ON/OFF the operating buttons, so that not all the impact due to the movement of the members is applied in the ON/OFF direction of electric contacts provided within the switch main bodies, whereby it is possible to avoid damage of the contacts and to prevent generation of chattering.

In order to perform a driving operation, the tool main body may be pressed against a material to undergo driving to thereby move the contact lever; then, the fan switch is turned on, and the combustible gas is supplied to the combustion chamber, and, further, the electric motor is started to rotate the fan for agitation. When the switch lever is pulled, the operating lever portion moves to move the operating button of the ignition switch to turn on the ignition switch, and the combustible gas in the combustion gas is ignited by the resultant spark from the ignition plug.

The fan switch may be arranged such that the direction in which the operating button thereof moves crosses the moving direction of the contact lever. The ignition switch is arranged such that the direction in which the operating button thereof moves crosses the moving direction of the operating lever. As a result, the directions in which both operating buttons move cross the directions in which the impact is applied to the contact lever or the switch lever as a result of the driving operation or the like, with the result that not all the impact is applied to the operating buttons, whereby the impact applied to both switches is mitigated, making it possible to prevent damage thereof.

DETAILED DESCRIPTION OF THE INVENTION

Figure 1:
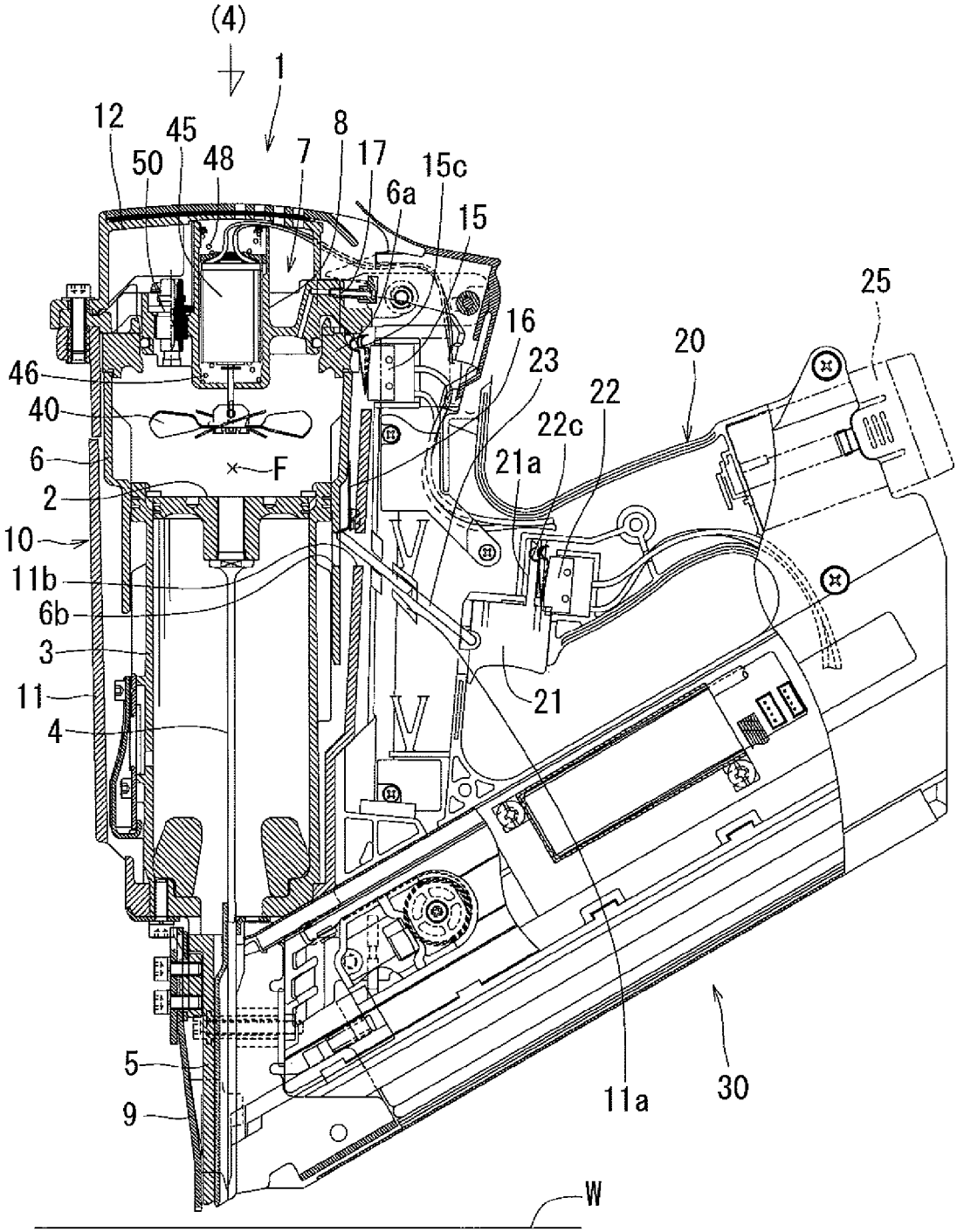
FIG. 1 A vertical sectional view of an entire combustion type driving tool according to an embodiment.

Next, an embodiment of the present invention will be described with reference to FIGS. 1 through 8. FIG. 1 shows a combustion type driving tool 1 equipped with a motor support structure according to this embodiment. The driving tool 1 includes a main body portion 10 having a piston 2 and a cylinder 3 therein, a handle portion 20 extending laterally from a side portion of the main body portion 10, and a magazine 30 provided so as to extend between a leading end portion of the handle portion 20 and a leading end portion of the main body portion 10. In the following description, regarding the moving direction of each portion and each member, it will be assumed that the direction in which a member to be driven is driven is downward. Thus, in FIG. 1, the driving direction is downward.

The cylinder 3, which is of a circular cylindrical configuration, is fixed in position on the inner peripheral side of a main body case 11 of the main body portion 10. The piston 2 is supported on the inner peripheral side of the cylinder 3 so as to be able to reciprocate. A driver 4 for the purpose of driving is mounted to the center of the lower surface of the piston 2. The driver 4 extends long downwardly from the center of the piston 2, and its leading end portion reaches the interior of a driver guide 5. The driver guide 5 serves to guide the driver 4 in the driving direction, and is provided so as to extend downwardly from the lower end portion of the main body portion 10. The leading end portion with respect to the feeding direction of the magazine 30 is connected to the driver guide 5. The magazine 30 is loaded with a connected driven member, in which a large number of driven members are connected together in parallel. By means of an interlock mechanism (not shown), the connected driven member loaded into the magazine 30 is pitch-fed to the side of the driver 5 in conjunction with the driving operation of the main body portion 10 whereby the driven members are supplied one by one into the driver guide 5. One of the driven members is struck by the driver 4, and is ejected from the leading end of the driver guide 5.

The handle portion 20 is a portion to be grasped by the user and, at its base portion, there is arranged a switch lever 21 to be pulled by a finger of the user. When the switch lever 21 is pulled, an ignition switch 22 is turned on to effect the driving operation. The construction of the ignition switch 22 and its peripheral structure will be described later.

A rechargeable battery pack 25 is mounted to the leading end of the handle portion 20. Using the battery pack 25 as the power source, an electric motor 45 is started for rotating a fan 40 for effecting agitation in a combustion chamber described below.

On top of the cylinder 3, a cylindrical tubular combustion chamber wall 6 is vertically movably supported. A space portion provided on the inner peripheral side of the combustion chamber wall 6 and defined by a cylinder head 7, the combustion chamber wall 6, the piston 2, and the cylinder 3 serves as a combustion chamber F. When the combustion chamber wall 6 moves upwards, the combustion chamber F is closed airtight, and a combustible gas is supplied thereto to undergo combustion. When the combustion chamber wall 6 moves downwards, the combustion chamber F is opened to be exhausted.

Figure 2:
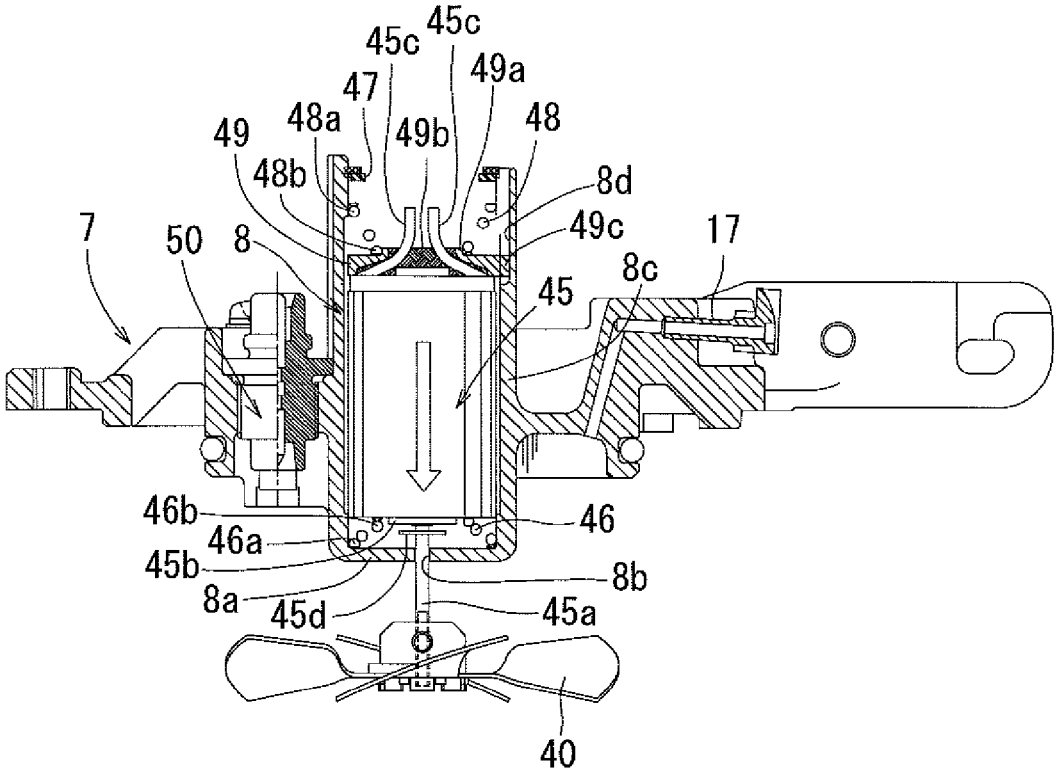
FIG. 2 A vertical sectional view of a cylinder head. This figure shows the state where an electric motor has moved downwards within a motor accommodating portion.
Figure 3:
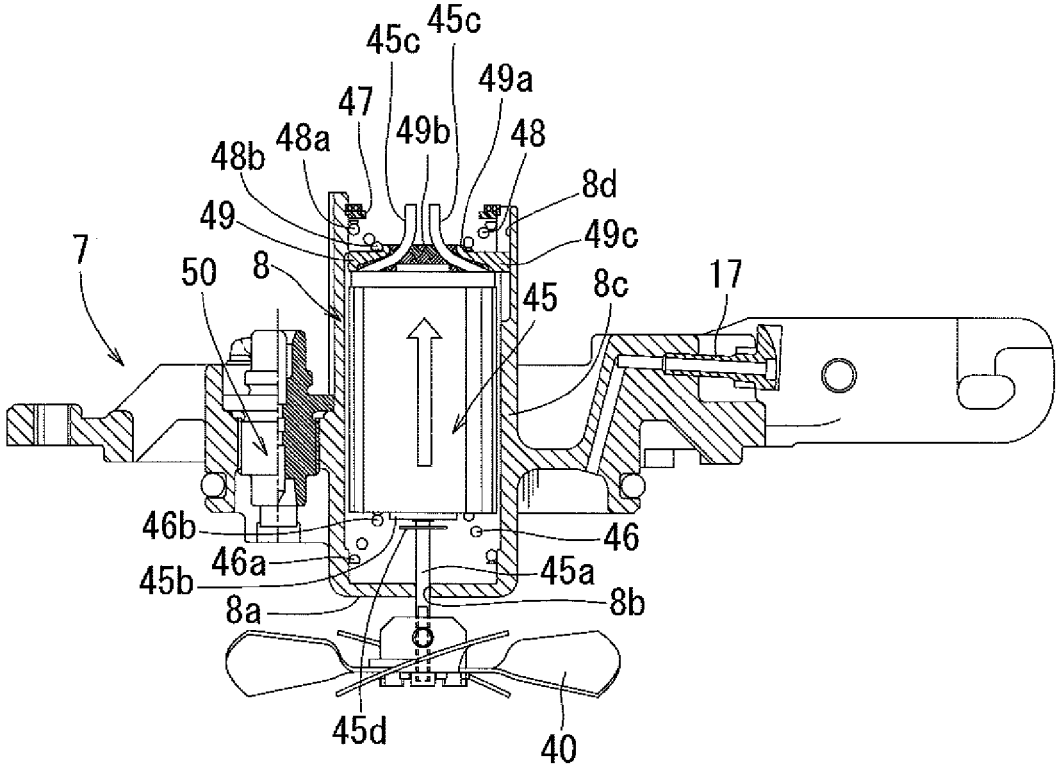
FIG. 3 A vertical sectional view of the cylinder head. This figure shows the state where the electric motor has moved upwards within the motor accommodating portion.
Figure 4:
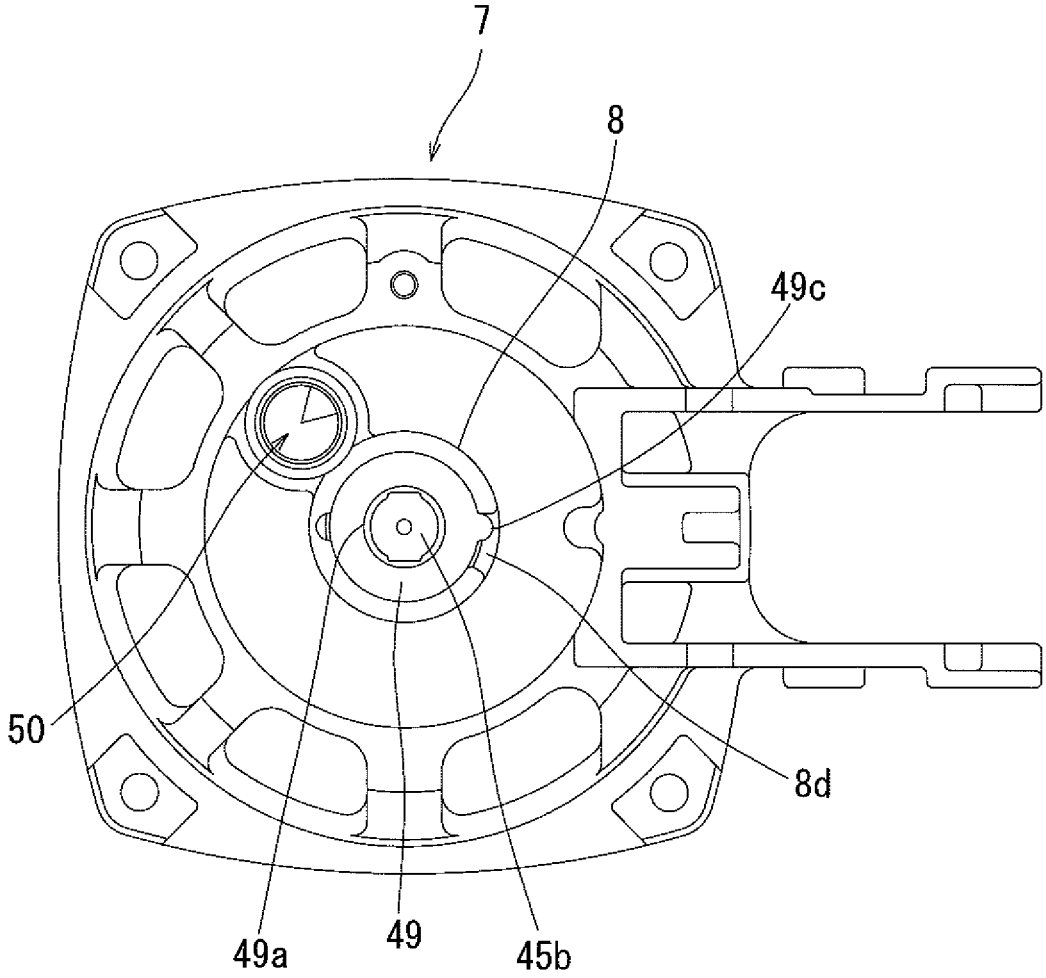
FIG. 4 A plan view of the cylinder head as seen from the direction of arrow (4) in FIG. 1.

The peripheral construction of the combustion chamber F is shown in enlarged views in FIGS. 2 and 3. A gas cylinder (not shown) filled with the combustible gas is mounted to a lateral side portion of the combustion chamber F and between the combustion chamber wall 6 and the handle portion 20. As the gas cylinder, a cassette type one that can be easily replaced by a new one when used up is used. The leading end portion of the driver guide 5 is brought to contact with a driving portion of a material W to undergo driving, and, in this state, the main body portion 10 is pressed against it in the driving direction (downwardly as viewed in FIG. 1), whereby a contact lever 9 provided to extend along the driver guide 5 moves upwards relative to the main body portion 10; then, through the relative movement of the contact lever 9, the combustion chamber wall 6 moves upwards to close the combustion chamber F airtight, and, in conjunction with this, a predetermined amount of combustible gas is injected into the combustion chamber F from the gas cylinder. The basic construction of this combustible gas supply mechanism belongs to a technique publicly known in the art, and needs no particular change in this embodiment.

The rear side of the cylinder head 7 is closed by a rear case 12 mounted to the rear portion of the main body case 11.

The combustible gas supplied into the combustion chamber F is mixed with air to produce an air fuel mixture of a predetermined mixing ratio. To efficiently produce this air fuel mixture and to enhance the combustion efficiency at the time of combustion, the above-mentioned fan 40 for agitation is provided in the combustion chamber F. The fan 40 rotates using the electric motor 45 as the drive source. The electric motor 45 generally has a cylindrical configuration and is retained in a cylindrical tubular motor accommodating portion 8 provided in the cylinder head 7. An output shaft 45*a* of the electric motor 45 protrudes into the combustion chamber F from within the motor accommodating portion 8 via an insertion hole 8*b* provided in a front wall 8*a* of the motor accommodating portion 8, and the fan 40 is mounted to this protruding portion.

The electric motor 45 is supported within the motor accommodating portion 8 so as to be able to move in the direction of the rotation axis thereof (i.e., the axial direction of the output shaft 45*a*). A compression spring 46 is provided between the front wall 8*a* of the motor accommodating portion 8 and the front surface of the electric motor 45. The electric motor 45 is urged rearwards (upwards as viewed in FIG. 1) by the front compression spring 46. A retaining ring 47 for a hole is attached to the inner periphery of the rear portion of the motor accommodating portion 8. Also, a compression spring 48 is provided between the retaining ring 47 and the rear surface of the electric motor 45 (a rear surface protecting cap 49 described later). The retaining ring 47 serves as the rear wall of the motor accommodating portion 8. The electric motor 45 is urged forwards by the rear compression spring 48. By means of the front and rear compression springs 46, 48, the electric motor 45 is supported within the motor accommodating portion 8 in a floating state in which it is elastically urged toward opposite sides with respect to the rotation axis direction.

The electric motor 45 is supported by a side wall 8*c* of the motor accommodating portion 8 so as to be substantially free from shifting in a radial direction (the direction orthogonal to the rotation axis, i.e., the left and right directions as viewed in FIG. 1).

In this way, the electric motor 45 is supported from opposite sides in the rotation axis direction in a floating state, whereby impact at the time of combustion (explosion) of the combustible gas or at the time of driving reaction is absorbed, thus preventing the impact from being directly transmitted to the electric motor 45.

As each of the compression springs 46, 48, a helical spring having a truncated-cone-shaped configuration with a gradually changing coil diameter (i.e., so-called conical springs) is used. Thus, when the compression springs 46, 48 are compressed, the small diameter side end portions 46*b*, 48*b* may successively enter the inner peripheral side of the large diameter side end portions 46*a*, 48*a* so as to be brought into a planar spiral state. Thus, both compression springs 46, 48 can finally be compressed to a width dimension corresponding to the wire diameter thereof. In contrast, in the case of a cylindrical compression spring, which exhibits no change in coil diameter, the spring may not be compressed to a size less than a width dimension corresponding to the value obtained by multiplying the wire diameter thereof by the winding number even when compressed to a maximum degree. Thus, by using truncated-cone-shaped conical springs as the front and rear compression springs 46, 48 as described above, it is possible to secure, within the motor accommodating portion 8 of the same dimension in the rotation axis direction, a large distance by which the electric motor 45 can move, whereby it is possible to endow the support structure for the electric motor 45 with an impact absorption tolerance (impact absorption capacity) larger than that in the prior art without enlarging the motor accommodating portion 8.

The large diameter side end portion 46*a* of the front side compression spring 46 abuts the front wall 8*a* of the motor accommodating portion 8, and the small diameter side end portion 46*b* thereof abuts the front surface of the electric motor 45. The large diameter side end portion 46*a* is in direct contact with the front wall 8*a* while its displacement in the radial direction being restricted by the side wall 8*c*. On the other hand, the small diameter side end portion 46*b* is in contact with the front surface of the electric motor 45 in the state that its displacement in the radial direction is restricted by fitting a boss portion 45*b* provided on the front surface of the electric motor 45 into the inner peripheral side thereof without clearance. As a result, the front side compression spring 46 is provided in such a state that its displacement from the position where it is concentric with the rotation axis of the electric motor 45 is restricted.

The large diameter side end portion 48*a* of the rear side compression spring 48 is in contact with the retaining ring 47, and the small diameter side end portion 48*b* thereof is in indirect contact with the rear surface of the electric motor 45 through the intermediation of the rear surface protecting cap 49. As in the case of the front side compression spring 46, the large diameter side end portion 48*a* is in contact with the retaining ring 47 in such a state that its displacement in the radial direction is restricted by the side wall 8*c*. The small diameter side end portion 48*b* of the rear side compression spring 48 is in indirect contact with the rear surface of the electric motor 45 through the intermediation of the rear surface protecting cap 49 in such a state that its displacement in the radial direction is restricted by fitting, a boss portion 49*a* provided at the center of the rear surface protecting cap 49 into the inner peripheral side thereof without clearance. The front and rear compression springs 46, 48 thus mounted are arranged so as to be coaxial about the rotation axis of the electric motor 45.

The rear surface protecting cap 49 is formed of synthetic resin in an annular configuration having substantially the same outer diameter as that of the electric motor 45 and is supported along the rear surface of the electric motor 45. Two lead wires 45*c*, 45*c* of the electric motor 45 are led out from the inner peripheral side of the rear surface protecting cap 49. The inner peripheral side of the rear surface protecting cap 49 is filled with a coating material 49*b*, whereby damage of both lead wires 45*c*, 45*c* is prevented.

The rear surface protecting cap 49 is provided with an engagement portion 49*c* protruding toward the outer peripheral side. The engagement portion 49*c* is inserted into an engagement groove portion 8*d* provided in the side wall 8*c* of the motor support portion 8. The engagement groove portion 8*d* is formed long within a predetermined range in the direction of the rotation axis of the electric motor 45. Thus, when the electric motor 45 moves within the motor support portion 8 in the direction of the rotation axis thereof, the rear surface protecting cap 49 moves together therewith, so that its engagement portion 49*c* moves in the same direction within the engagement groove portion 8*d*.

A seal plate 45*d* of an annular configuration is attached to the output shaft 45*a* of the electric motor 45. The seal plate 45*d* is retained at a position where it is substantially in contact with the boss portion 45*b*. With the seal plate 45*d*, even in the case that the air fuel mixture in the combustion chamber F enters the motor support portion 8 via the insertion hole 8*b* of the front wall 8*a*, the air fuel mixture is intercepted by the seal plate 45*d* and is prevented from directly entering the interior of the motor via the support portion (boss portion 45*b*) of the output shaft 45*a*.

Figure 5:
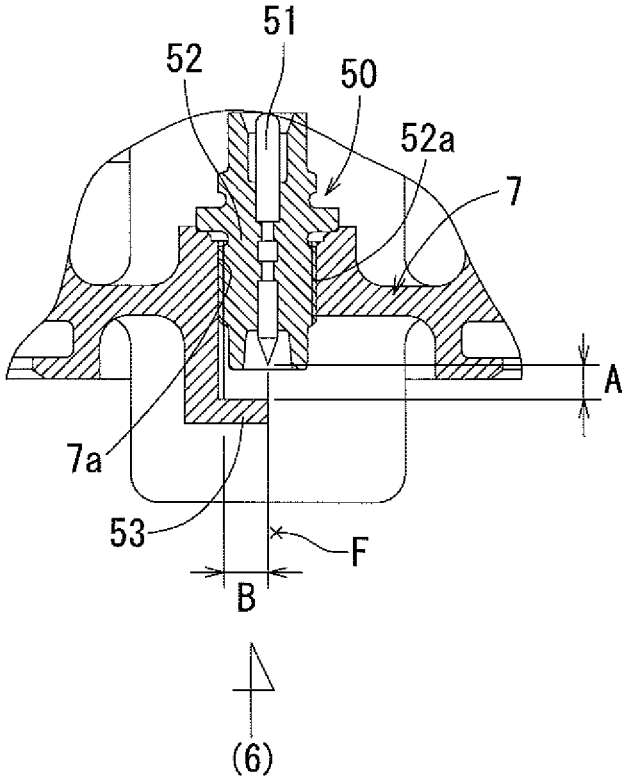
FIG. 5 A vertical sectional view of an ignition plug and its peripheral portion.
Figure 6:
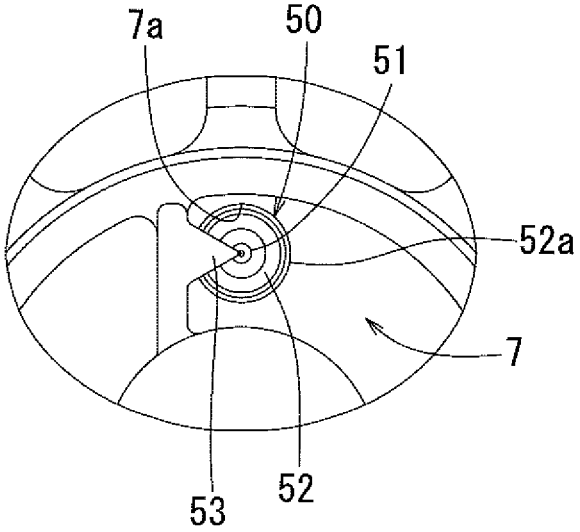
FIG. 6 A plan view of the ignition plug and its peripheral portion as seen from the direction of arrow (6) in FIG. 5.

Next, an ignition plug 50 for generating a spark in the combustion chamber F is mounted to the cylinder head 7. FIGS. 5 and 6 are enlarged views of the construction of the ignition plug 50 and its peripheral structure. The ignition plug 50 is equipped with a plug anode 51 and a plug insulating portion 52. The plug anode 51 is covered with the plug insulating portion 52 except for the forward end portion and the rear portion thereof. A mounting screw portion 52*a* of the plug insulating portion 52 is fastened to a mounting screw hole 7*a* provided in the cylinder head 7, whereby the ignition plug 50 is mounted in the state that the forward end portion of the plug anode 51 is directed to the side of the combustion chamber F.

The plug insulating portion 52 of this embodiment is formed as an integral unit of a resin molding material having high dielectric strength. More specifically, as the material, a thermoplastic engineering plastic whose dielectric strength is of low temperature dependence, such as PPS resin (polyphenylene sulfide), is used. It is also possible to use PBT resin (polybutylene terephthalate). Conventionally, the dielectric strength (breakdown strength, i.e., the withstand voltage of an insulating material) of a plug insulating portion formed of a nylon resin is usually reduced to approximately 10 kV/mm at around 100° C. However, by using such a thermoplastic engineering plastic as the material, it is possible to secure a dielectric strength of at least approximately 12 kV/mm at 100° C., whereby, even at high temperature, it is possible to substantially suppress electric current leakage as compared with that in the prior art, so that a spark can be reliably generated between the plug anode 51 and the forward end portion of a plug cathode 53.

The creepage distance B (which corresponds to the radius of the mounting screw portion 52*a* of the plug insulating portion 52) shown in FIG. 5 is set to be at least 1.5 times the gap (which is of dimension A in FIG. 5) between the plug anode 51 and the plug cathode 53 (i.e., not less than 1.5 times the plug gap). In this way, the diameter of the plug insulating portion 51 (mainly the screw diameter of the mounting screw portion 52*a*) is set using the gap between the plug anode 51 and the plug cathode 53 (plug gap) as a reference, which also helps to ensure generation of a spark through electric discharge between the forward end portion of the plug anode 51 and the plug cathode 53, thus securing a reliable ignition of the combustible gas.

Conventionally, the plug insulating portion has been formed of nylon, or its wall thickness has not been sufficiently large, so that the dielectric strength of the plug insulating portion has been insufficient; thus, electric current leakage is allowed to occur in the plug insulating portion at high temperature, with the result that a sufficient electric discharge is not effected between the forward end portion of the plug anode and the plug cathode, resulting, in some case, in ignition error, and, consequently, in defective driving operation. In this respect, as described above, the plug insulating portion 52 is formed of PPS resin, and the creepage distance B thereof (which corresponds to the radius of the mounting screw portion 52*a*) is set to be at least 1.5 times the plug gap A, whereby electric current leakage at the plug insulating portion 52 is suppressed, and a spark is reliably generated between the forward end portion of the plug anode 51 and the plug cathode 53, thereby making it possible to reliably ignite the combustible gas.

The plug cathode 53 is formed of aluminum and is provided integrally with the cylinder head 7.

Figure 7:
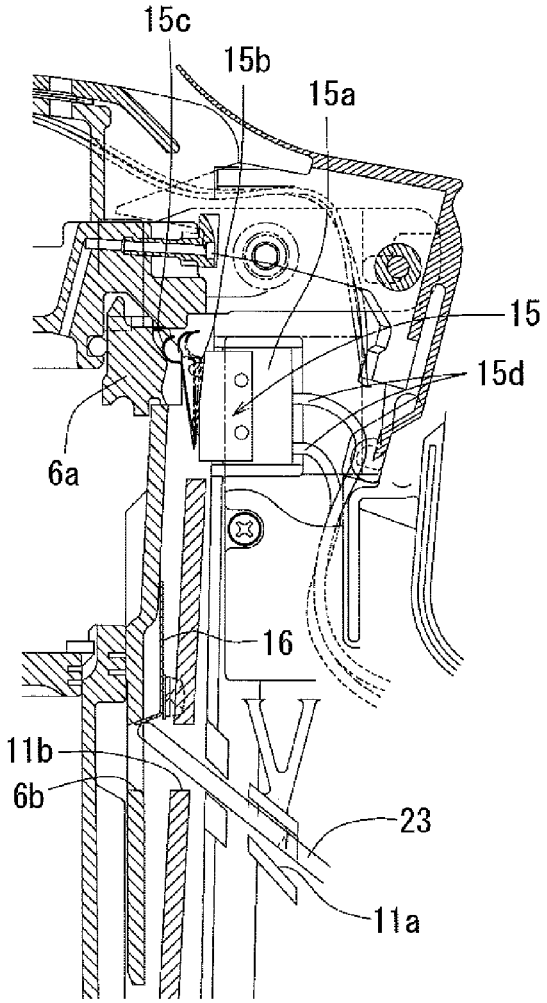
FIG. 7 A side view of a fan switch and its peripheral portion. In this figure, the solid line indicates an operating lever at an OFF position, and the chain double-dashed line indicates the operating lever in the state that it has moved to an ON position.
Figure 8:
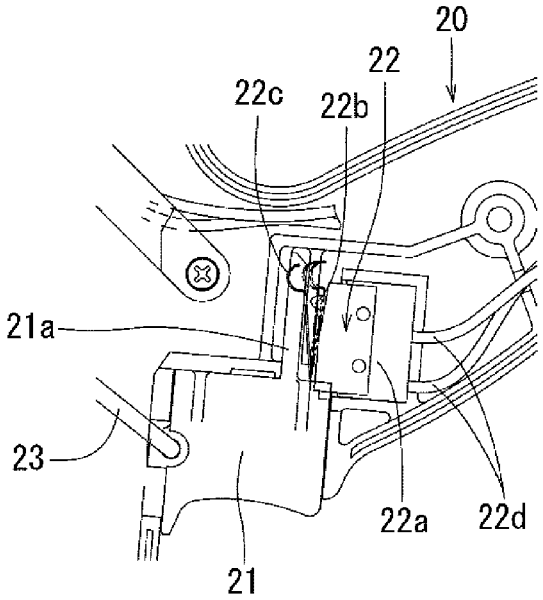
FIG. 8 A side view of an ignition switch and its peripheral portion. In this figure, the solid line indicates an operating lever at an OFF position, and the chain double-dashed line indicates the operating lever in the state that it has moved to an ON position.

Next, a fan switch 15 is arranged on the lateral side of the combustion chamber wall 6, and an ignition switch 22 is arranged near the base end portion of the handle portion 20. FIG. 7 is an enlarged view of the fan switch 15 and its peripheral structure, and FIG. 8 is an enlarged view of the ignition switch 22 and its peripheral structure.

Well-known microswitches are used as both switches 15, 22. The switches 15, 22 are respectively equipped with main body portions 15*a*, 22*a*, operating buttons 15*b*, 22*b* provided on the lateral side portions of the main body portions 15*a*, 22*a* and adapted to move between an ON position and an OFF position, and operating levers 15*c*, 22*c* tiltably provided on the lateral side portions of the main body portions 15*a*, 22*a* and adapted to tilt between an ON position and an OFF position. When the operating levers 15*c*, 22*c* tilt to the ON position, the operating buttons 15*b*, 22*b* are pushed in, whereby the switch main body portions 15*a*, 22*a* are turned on. When the switch main body portions 15*a*, 22*a* are turned on, an ON signal is output to a control circuit via wirings 15*d*, 22*d*.

Through an ON operation of the contact lever 9, the gas cylinder is opened by a well-known mechanical means (not shown), and a predetermined amount of combustible gas is supplied into the combustion chamber F; and, in conjunction with this, the fan switch 15 is turned on, whereby the electric motor 45 is started and the fan 40 starts to rotate. On the other hand, when the ignition switch 22 is turned on, the combustible gas in the combustion chamber F is ignited by a spark from the ignition plug 50, so that the piston 2 moves downwards to perform driving operation.

As described above, the contact lever 9 is provided along the driver guide 5 so as to be capable of relative upward and downward movements. Bringing the leading end of the contact lever 9 into contact with the material to undergo driving and pressing the main body portion 10 in the driving direction causes the contact lever 9 to make relative upward movement.

The contact lever 9 is connected to the combustion chamber wall 6 via a connection lever (not shown). Thus, when the contact lever 9 moves upwards relative to the main body 10 (i.e., undergoes an ON operation), the combustion chamber wall 6 moves upwards to close the gap between itself and the cylinder head 7, thereby closing the combustion chamber F airtight. In contrast, when the pressing of the main body portion 10 is released, the contact lever 9 makes a relative downward movement (i.e., undergoes an OFF operation). When the contact lever 9 is lowered to the OFF position, the leading end portion thereof protrudes downwards beyond the forward end portion of the driver guide 5 by a predetermined dimension, and the combustion chamber wall 6 moves downwards to open the combustion chamber F.

When the combustion chamber wall 6 moves upwards through the ON operation of the contact lever 9 to close the combustion chamber F, the fan switch 15 is turned on. An annular seal member 6*a*, which is adapted to close the combustion chamber F airtight by being pressed by the cylinder head 7, is attached to the entire periphery of the upper portion of the combustion chamber wall 6. The fan switch 15 is arranged laterally of the seal member 6*a*.

When the seal member 6*a* moves upwards in unison with the combustion chamber wall 6 through the ON operation of the contact lever 9, the operating lever 15*c* of the fan switch 15 is pressed toward the ON position (to the right side as viewed in FIG. 7) to be tilted, whereby the operating button 15*b* is pushed to the ON position, thereby turning on the fan switch 15. Conversely, when the seal member 6*a* moves downwards in unison with the combustion chamber wall 6 through the OFF operation of the contact lever 9, the seal member 6*a* retreats downwards from the lateral side of the operating lever 15*c*. When the seal member 6*a* retreats from the lateral side, the operating lever 15*c* is restored to the OFF position by the urging force of the operating button 15*b*, so that the operating button 15*b* is restored to the OFF position, turning off the fan switch 15.

In this way, the mounting position (orientation) of the fan switch 15 is set such that the moving direction (ON/OFF operating direction) of the operating lever 15*c* and the operating button 15*b* of the fan switch 15 crosses the moving direction of the seal member 6*a* (the driving direction for the driven member) at a right angle or at an angle close thereto. Thus, the impact in the vertical direction at the time of the ON/OFF operation of the contact lever 9, etc. is not applied directly to the operating button 15*b* and the switch main body 15*a* via the operating lever 15*c*, whereby it is possible to enhance the durability of the fan switch 15.

On the other hand, as shown in FIG. 8, on top of the switch lever 21, there is provided an operating lever 21*a* in a state of protruding upwards. The ignition switch 22 is arranged laterally (the right-hand side as viewed in FIG. 8) of the operating lever portion 21*a*.

When the user pulls the switch lever 21 upwards by a fingertip, the operating lever portion 21*a* moves upwards in unison therewith. When the operating lever 21*a* moves upwards, the operating lever 22*c* of the ignition switch 22 situated laterally of it is pressed toward the ON position (to the right as viewed in FIG. 8), and is tilted, whereby the operating button 22*b* is pushed to the ON position to turn on the ignition switch 22. Conversely, when the pulling of the switch lever 21 is released, the switch lever 21 is restored to the OFF position on the lower side by the urging force of a compression spring (not shown). When the switch lever 21 is restored to the OFF position, the operating lever 21*a* moves downwards in unison therewith, and retreats from the lateral side of the operating lever 22*c* of the ignition switch 22. As a result, the operating lever 22*c* is restored to the OFF position by the urging force of the operating button 22*b*, so that the operating button 22*b* is restored to the OFF position to turn off the ignition switch 22.

In this way, the mounting position (orientation) of the ignition switch 22 is set such that the moving direction (ON/OFF operating direction) of the ignition switch 22, the operating lever 22*e*, and the operating button 22*b* crosses the operating direction of the switch lever 21 at a right angle or an angle close thereto. Therefore, the impact in the vertical direction at the time of ON/OFF operation of the switch lever 21 is not directly applied to the operating button 22*b* and the switch main body 22*a* via the operating lever 22*c*, whereby it is possible to enhance the durability of the ignition switch 22.

In this way, according to the driving tool 1 of this embodiment, the ON/OFF operating direction of the fan switch 15 and the ignition switch 22 is orthogonal to or crosses the moving direction of the contact lever 9 and the switch lever 21, which are moved at the time of driving operation, so that it is possible to protect the fan switch 15 and the ignition switch 22 from the impact generated through the operation.

The switch lever 21 is provided with a restriction bar 23. The restriction bar 23 is supported on a lateral portion of the switch lever 21 so as to be vertically pivotable. The restriction bar 23 is inserted into a guide hole 11*a* provided in the main body case 11. The restriction bar 23 is inserted into the guide hole 11*a* so as to be capable of being displaced therein within a predetermined range not only in the longitudinal direction but also in the lateral direction thereof. The leading end side of the restriction bar 23 reaches a lateral portion of the combustion chamber wall 6 via the insertion hole 11*b* of the main body case 11.

At a position opposed to the leading end portion of the restriction bar 23 and on the lateral side of the combustion chamber wall 6, there is mounted a restriction plate 16, and there is provided a relief hole 6*b*.

When the switch lever 21 is pulled upwards in the state that the contact lever 9 has been operated to the ON operation to move the combustion chamber wall 6 upwards, the restriction lever 23 is displaced in the longitudinal direction and obliquely upwards, and the leading end portion thereof enters the relief hole 6*b* via a route below the restriction plate 16. Therefore, in this state, the downward movement of the combustion chamber wall 6 is restricted, so that the combustion chamber F is maintained in a state in which it is closed airtight.

In contrast, in the state in which the ON operation is not performed on the contact lever 9 (OFF state) and in which the combustion chamber wall 6 is open, the restriction plate 16 is situated at a position opposed to the restriction bar 23, so that the oblique upward movement of the restriction bar 23 is restricted, thus making it impossible to pull the switch lever 21. Thus, the driving operation is effected according to driving operation procedures in which the ON operation of the contact lever 9 is first performed, and thereafter, the switch lever 21 is pulled. No driving operation is effected by the reverse operation procedures, thus preventing erroneous operation.

According to the driving tool 1 of this embodiment constructed as described above, the electric motor 45 for rotating the fan 40 for effecting agitation in the combustion chamber is started through the ON operation of the fan switch 15, and the ignition plug 50 for igniting the combustible gas supplied to the combustion chamber F is ignited through the ON operation of the ignition switch 22, while the ON operations of the operating buttons 15*b*, 22*b* of the switches 15, 22 being effected through movement of the contact lever 9 and the operating lever portion 21*a* moving in a direction substantially orthogonal to the moving direction of the operating buttons 15*b*, 22*b*.

Thus, not all the impact applied to the contact lever 9 or the switch lever 21 through the driving operation, etc. is applied to the operating buttons 15*b*, 22*b* in the moving direction thereof, so that it is possible to mitigate the impact directly applied to the operating buttons 15*b*, 22*b*, thereby preventing damage of the switches 15, 22 and enhancing the durability thereof.

The embodiment described above allows various modifications. For example, although in the above example the fan switch 15 is arranged such that the moving direction of the operating button 15*b* of the fan switch 15 crosses the moving direction of the contact lever 9 substantially at a right angle, and the ignition switch 22 is arranged such that the moving direction of the operating button 22*b* of the ignition switch 22 crosses the moving direction of the operating lever portion of the switch lever 21 substantially at a right angle, it is not necessary to set these directions to cross exactly at a right angle, and each moving direction may be set so as to be inclined at an appropriate angle. Even in this case, it is possible to prevent the impact applied via the contact lever 6 or the impact applied via the switch lever 21 from being all applied to the operating buttons 15*b*, 22*b*, making it possible to prevent damage of the switches 15, 22.

In short, as long as the moving direction of the contact lever 6 and the moving direction of the switch lever 21 do not coincide with (i.e., as long as they cross) the moving direction of the operating button 15*b* of the fan switch 15 and the moving direction of the operating button 22*b* of the ignition switch 22, not all the impact applied in the moving direction of the contact lever 6 and in the moving direction of the switch lever 21 is applied to the operating buttons 15*b*, 22*b* (i.e., the impact is mitigated), so that it is possible to prevent damage of the switches 15, 22.

The invention claimed is:

1. A combustion type driving tool comprising:

a combustion chamber;

an electric motor for rotating a fan for agitation; and an ignition plug for igniting a combustible gas;

wherein the electric motor is supported, within a motor accommodating chamber provided in the combustion chamber, in a floating state in which the electric motor is elastically urged toward opposite sides in the rotation axis direction thereof via truncated-cone-shaped coil springs whose coil diameter exhibits a gradual change.

2. A combustion type driving tool comprising:

a combustion chamber;

an electric motor for rotating a fan for agitation;

an ignition plug for igniting a combustible gas;

a fan switch for starting the electric motor to rotate the fan; and an ignition switch for igniting the ignition plug, wherein the fan switch and the ignition switch comprise microswitches turned on through movement of operating buttons, wherein the microswitches are arranged in such directions that the moving directions of the operating buttons cross directions of movement of members that move the operating buttons, respectively, and wherein the electric motor is supported, within a motor accommodating chamber provided in the combustion chamber, in a floating state in which the electric motor is elastically urged toward opposite sides in the rotation axis direction thereof via truncated-cone-shaped coil springs whose coil diameter exhibits a gradual change.

3. A driving tool according to claim 2, wherein the fan switch is turned on through movement of the operating button as a result of movement of a contact lever effected by an operation of pressing a tool main body against a material to undergo driving, the ignition switch is turned on through movement of the operating button as a result of movement of an operating lever portion effected by pulling a switch lever, and wherein the fan switch is arranged such that the moving direction of the operating button thereof crosses the moving direction of the contact lever, and the ignition switch is arranged such that the moving direction of the operating button thereof crosses the moving direction of the operating lever portion.

4. A driving tool according to claim 3, wherein the operating lever portion is provided integrally with the switch lever so as to extend in an ON operation direction of the switch lever.

5. A driving tool according to claim 3, wherein a combustion chamber wall moves through an ON operation of the contact lever to hermetically close the combustion chamber, and wherein the operating button of the fan switch moves toward the side of an ON position through movement of a seal member provided on the combustion chamber wall.

6. A driving tool according to claim 5, wherein when the combustion chamber is hermetically closed through the ON operation of the contact lever, the combustible gas is supplied into the combustion chamber through movement of the combustion chamber wall, and the fan switch is turned on to rotate the fan for agitation.

7. A driving tool according to claim 3, further comprising a restriction bar allowing the pulling of the switch lever solely in the state in which the ON operation of the contact lever has been effected.

8. A driving tool according to claim 7, wherein the movement of the combustion chamber wall is restricted by the restriction bar to maintain the hermetically closed state of the combustion chamber.

* * * * *